US009052686B2

(12) United States Patent
Munetsugu et al.

(10) Patent No.: US 9,052,686 B2
(45) Date of Patent: Jun. 9, 2015

(54) PROCESS CARTRIDGE

(71) Applicant: CANON KABUSHIKI KAISHA, Tokyo (JP)

(72) Inventors: Hiroyuki Munetsugu, Yokohama (JP); Tatsuya Suzuki, Kawasaki (JP); Yosuke Kashiide, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/020,406

(22) Filed: Sep. 6, 2013

(65) Prior Publication Data

US 2014/0072339 A1 Mar. 13, 2014

(30) Foreign Application Priority Data

Sep. 11, 2012 (JP) ..... 2012-199099

(51) Int. Cl.
*G03G 15/04* (2006.01)
*G03G 21/18* (2006.01)

(52) U.S. Cl.
CPC .... *G03G 21/1825* (2013.01); *G03G 2221/1861* (2013.01); *G03G 21/1821* (2013.01)

(58) Field of Classification Search
CPC ..... G03G 21/1821; G03G 21/1825; G03G 2221/1861
USPC ..... 399/113, 119
See application file for complete search history.

(56) References Cited

U.S. PATENT DOCUMENTS

| | | | | |
|---|---|---|---|---|
| 5,991,569 | A * | 11/1999 | Sugihara et al. | 399/113 |
| 2002/0071693 | A1* | 6/2002 | Shimaoka | 399/113 |
| 2006/0029423 | A1 | 2/2006 | Shiraki | |
| 2008/0138109 | A1 | 6/2008 | Anan et al. | |
| 2011/0274470 | A1* | 11/2011 | Miura | 399/269 |
| 2013/0051849 | A1 | 2/2013 | Itabashi et al. | |

FOREIGN PATENT DOCUMENTS

| | | | | |
|---|---|---|---|---|
| JP | 05204233 | A * | 8/1993 | G03G 15/08 |
| JP | 09-50224 | A | 2/1997 | |
| JP | 2001-066970 | A | 3/2001 | |
| JP | 2008-261910 | A | 10/2008 | |
| JP | 4280770 | B2 | 6/2009 | |

OTHER PUBLICATIONS

U.S. Appl. No. 14/019,948, filed Sep. 6, 2013, Yuichi Fukui.

* cited by examiner

*Primary Examiner* — Benjamin Schmitt
(74) *Attorney, Agent, or Firm* — Canon U.S.A., Inc. IP Division

(57) ABSTRACT

A process cartridge includes an image bearing member unit configured to rotatably support an image bearing member, and a developing unit configured to rotatably support a developer bearing member. The developing unit includes a first supported portion configured to be swingably supported with respect to the image bearing member unit, a second supported portion provided configured to be swingably and slidably supported with respect to the image bearing member unit, and a regulated portion configured to be capable of contacting a regulating portion provided on the image bearing member unit. The regulating portion regulates the developing unit from moving in a slide direction of the second supported portion, by contacting the regulated portion, when the image bearing member and the developer bearing member rotate while contacting to each other.

24 Claims, 11 Drawing Sheets

PROCESS CARTRIDGE

BACKGROUND OF THE INVENTION

1. Field of the Invention

The present invention relates to a process cartridge mountable/demountable to an image forming apparatus such as an electrophotographic image forming apparatus.

The image forming apparatus refers to an apparatus for forming an image on a recording material by employing an electrophotographic image forming process. Examples of the image forming apparatus include an electrophotographic copying machine, an electrophotographic printer (e.g., a laser beam printer, a light emitting diode (LED) printer), a facsimile machine, a word processor.

Further, the process cartridge is configured by integrally assembling into a cartridge a photosensitive drum as an image bearing member, and a developing roller (i.e., developer bearing member) as an image forming process unit acting on the photosensitive drum. Then, the process cartridge is configured to be detachably mountable to an apparatus main body of the image forming apparatus.

Further, the apparatus main body of the image forming apparatus refers to an image forming apparatus main body portion excluding the process cartridge.

2. Description of the Related Art

Conventionally, in an image forming apparatus using an electrophotographic image forming process, a photosensitive drum and an image forming process unit acting on the photosensitive drum are integrally assembled into a cartridge. Then, a process cartridge type in which the cartridge is mountable/demountable to the image forming apparatus main body is widely employed.

With the process cartridge type, a user can perform maintenance of the image forming apparatus without relying on a service engineer, and therefore operability can be dramatically improved.

For this reason, the process cartridge type is widely used in the image forming apparatuses.

The process cartridge is divided into a photosensitive drum unit having a photosensitive drum, and a developing unit having a developing roller. Further, the developing unit is configured to be relatively movable with respect to the photosensitive drum unit.

As one of the electrophotographic development types, there is a contact development type in which an elastic layer of the developing roller is contacted to the surface of the photosensitive drum to carryout image formation. In this case, the developing roller needs to be brought into contact with the photosensitive drum uniformly in a rotational axis direction of the photosensitive drum.

The developing roller is used by being urged to maintain a predetermined position at which the developing roller acts on the photosensitive drum at the time of image formation. As one of methods for urging the developing roller at a predetermined position, there is a type for supporting swingably with respect to the photosensitive drum, at both ends in a rotational axis direction of the developing roller of the developing unit, and swinging the developing unit by an urging member for applying a moment in a direction in which the developing roller comes into contact with the photosensitive drum.

The both ends in the rotational axis direction of the developing roller of the developing unit are supported swingably with respect to the photosensitive drum. In that case, the alignment between the rotational shaft of the developing roller, and a swing shaft of the developing unit is deviated due to component tolerance or the like. For this reason, a contact pressure of the developing roller with respect to the photosensitive drum may become non-uniform.

For example, Japanese patent Application Laid-Open No. 9-50224 discusses a configuration in which one end side in a rotational axis direction of the developing roller is supported swingably with respect to the photosensitive drum unit, and the other end side is supported swingably and movably. With this configuration, deviation of the alignment between the rotational shaft of the developing roller and the swing shaft of the developing unit is permitted.

However, in Japanese patent Application Laid-Open No. 9-50224, the other end side in the rotational axis direction of the developing roller of the developing unit is supported swingably and movably with respect to the photosensitive drum. Accordingly, the other end side in the rotational axis direction of the developing roller of the developing unit has a predetermined degree of freedom, and positioning is not performed positively.

Consequently, there is a problem that the contact position of the developing roller and the surface of the photosensitive drum may vary. As a result, the contact pressure of the developing roller to the photosensitive drum becomes unstable.

Conventionally, by optimizing an arrangement among the rotation center of the developing roller, the rotation center of the photosensitive drum, and the swing center of the developing unit, stabilization of the contact position of the developing roller and the surface of the photosensitive drum has been achieved.

For example, as illustrated in FIG. 11, an angle θ2 formed by a straight line "U" connecting a swing center "X" of the developing unit 9 and a contact point "N" of the developing roller 6 and the photosensitive drum 4, and a straight line "W" connecting a rotational shaft 6*b* of the developing roller 6 and a rotational shaft 4*b* of the photosensitive drum 4 is set at substantially right angle. Then, the contact position of the developing roller 6 and the surface of the photosensitive drum 4 becomes stable. Then, the contact pressure of the developing roller 6 to the photosensitive drum 4 becomes stable.

On the other side, in order to downsize the process cartridge P, a degree of freedom needs to be increased to the arrangement of each of the rotational shaft 6*b* of the developing roller 6, the rotational shaft 4*b* of the photosensitive drum 4, and the swing center "X" of the developing unit 9. Consequently, the angle θ2 at which the contact position of the developing roller 6 and the surface of the photosensitive drum 4 becomes stable may not be set at substantially right angle. As a result, the contact position of the developing roller 6 and the surface of the photosensitive drum 4 may vary, and the contact pressure of the developing roller 6 to the photosensitive drum 4 may become unstable.

SUMMARY OF THE INVENTION

The present invention is directed to a process cartridge capable of keeping a contact position of a developer bearing member with respect to an image bearing member highly accurate, even if a degree of freedom is increased to the arrangement of a swing center of a developing unit. Furthermore, a contact pressure of the developer bearing member to the image bearing member can be stabilized.

According to an aspect of the present invention, a process cartridge mountable/demountable to an apparatus main body of an image forming apparatus, includes an image bearing member unit configured to rotatably support an image bearing member, and a developing unit configured to rotatably support a developer bearing member, and to be provided swingably about a swing center between a contact position at which the developer bearing member and the image bearing member contact to each other, with respect to the image bearing member unit and a separation position at which the developer bearing member and the image bearing member are separated from each other, wherein the image bearing member unit includes a first supporting portion provided at one end side in a rotational axis direction of the image bearing member, configured to swingably support the developing unit, a second supporting portion provided at the other end side in the rotational axis direction of the image bearing member, configured to swingably and slidably support the developing unit, and a regulating portion configured to regulate movement of the developing unit, wherein the developing unit includes a first supported portion provided at one end side in a rotational axis direction of the developer bearing member, configured to be swingably supported with respect to the image bearing member unit, a second supported portion provided at the other end side in the rotational axis direction of the developer bearing member, configured to be swingably and slidably supported with respect to the image bearing member unit, and a regulated portion configured to be capable of contacting the regulating portion provided on the image bearing member unit, wherein the regulating portion regulates the developing unit from moving in a slide direction of the second supported portion, by contacting the regulated portion, when the image bearing member and the developer bearing member rotate while contacting to each other.

According to another aspect of the present invention, an image forming apparatus configured to form an image on a recording medium, includes an apparatus main body of the image forming apparatus, and a process cartridge configured to be removably mountable to the apparatus main body, wherein the process cartridge includes an image bearing member unit configured to rotatably support an image bearing member, and a developing unit configured to rotatably support a developer bearing member, and to be provided swingably about a swing center with respect to the image bearing member unit between a contact position at which the developer bearing member and the image bearing member contact to each other and a separation position at which the developer bearing member and the image bearing member are separated from each other, wherein the image bearing member unit includes a first supporting portion provided at one end side in a rotational axis direction of the image bearing member, configured to swingably support the developing unit, a second supporting portion provided at the other end side in a rotational axis direction of the image bearing member, configured to swingably and slidably support the developing unit, and a regulating portion configured to regulate movement of the developing unit, wherein the developing unit includes a first supported portion provided at one end side in a rotational axis direction of the developer bearing member, configured to be swingably supported with respect to the image bearing member unit, a second supported portion provided at the other end side in a rotational axis direction of the developer bearing member, configured to be swingably and slidably supported with respect to the image bearing member unit, and a regulated portion configured to be capable of contacting the regulating portion provided on the image bearing member unit, wherein the regulating portion regulates the developing unit from moving in a slide direction of the second supported portion, by contacting the regulated portion, when the image bearing member and the developer bearing member rotate while contacting to each other.

Further features of the present invention will become apparent from the following detailed description of exemplary embodiments with reference to the attached drawings.

DESCRIPTION OF THE EMBODIMENTS

An exemplary embodiment of a process cartridge according to the present invention will be specifically described with reference to the drawings.

First, a configuration of the process cartridge according to a first exemplary embodiment of the present invention will be described with reference to FIG. 1 through FIG. 8.

<Image Forming Apparatus>

Figure 1:
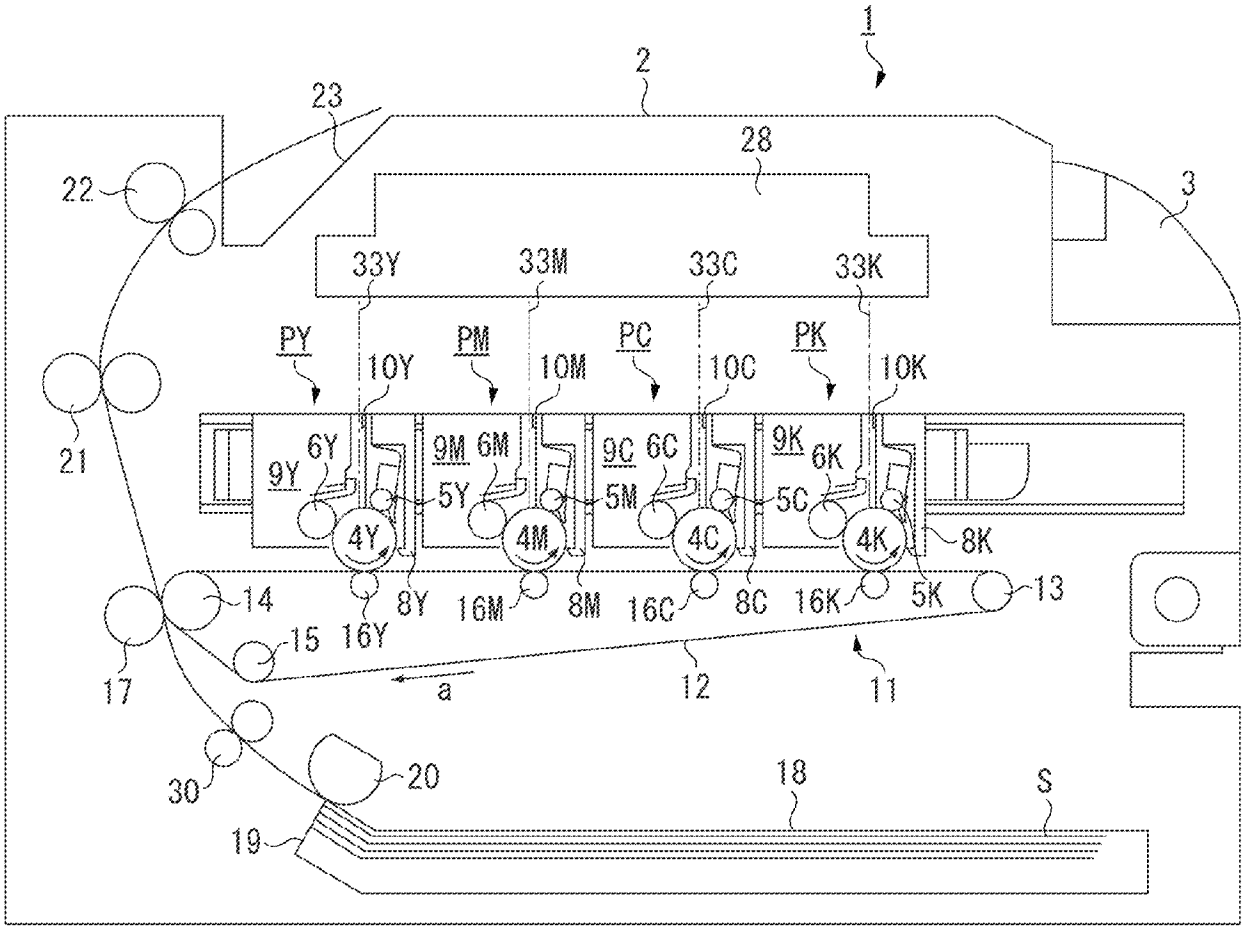
FIG. 1 is a cross-sectional view illustrating a configuration of an image forming apparatus provided with a process cartridge.

An image forming apparatus 1 illustrated in FIG. 1 is a full-color image forming apparatus to which four process cartridges PY, PM, PC, and PK are mountable/demountable. Y, C, M, and K indicate respective colors of yellow, cyan, magenta, and black. For convenience of descriptions, the process cartridges PY, PM, PC, and PK may sometimes be described using a process cartridge P as a representative. Components constituting other respective image forming units will be also described in this way.

The number of the process cartridges P to be mounted on the image forming apparatus 1 is not limited to four as illustrated in FIG. 1, but any number of the process cartridges may be selected as appropriate.

For example, in a case of the image forming apparatus that forms a monochrome image, the number of the process cartridges P mounted on the image forming apparatus is one. Further, in the exemplary embodiments described below, descriptions will be provided using a printer as an example of the image forming apparatus 1.

Figure 2:
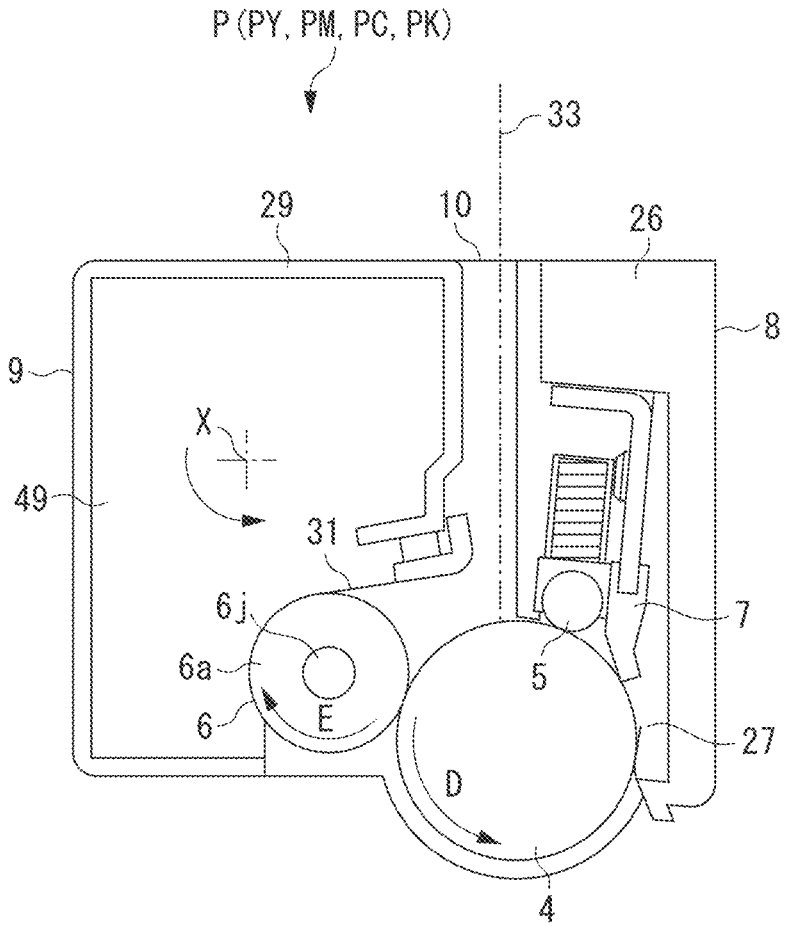
FIG. 2 is a cross-sectional view illustrating a configuration of the process cartridge according to a first exemplary embodiment of the present invention.
Figure 3:
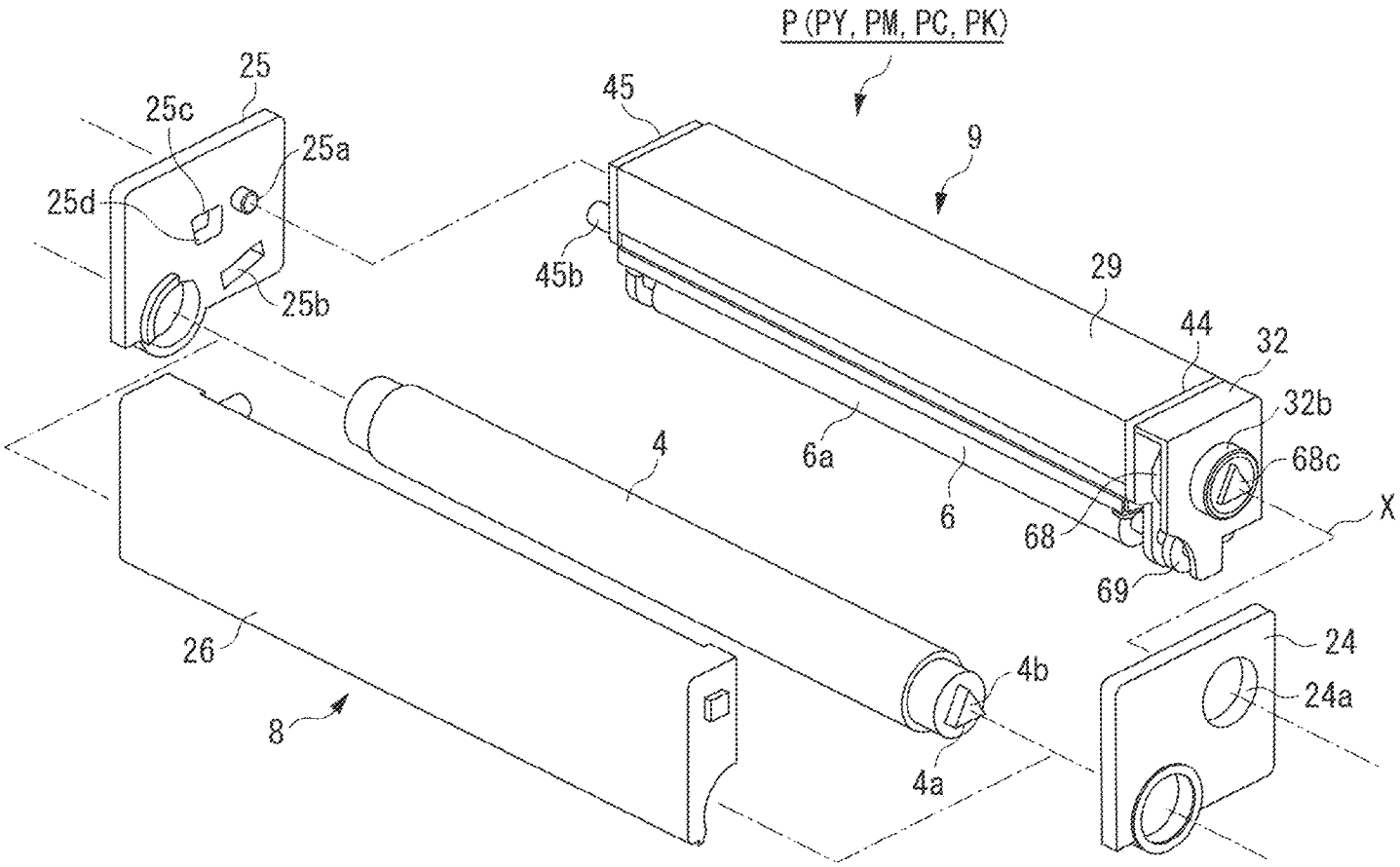
FIG. 3 is an exploded perspective view illustrating a configuration of the process cartridge according to the first exemplary embodiment.
Figure 4:
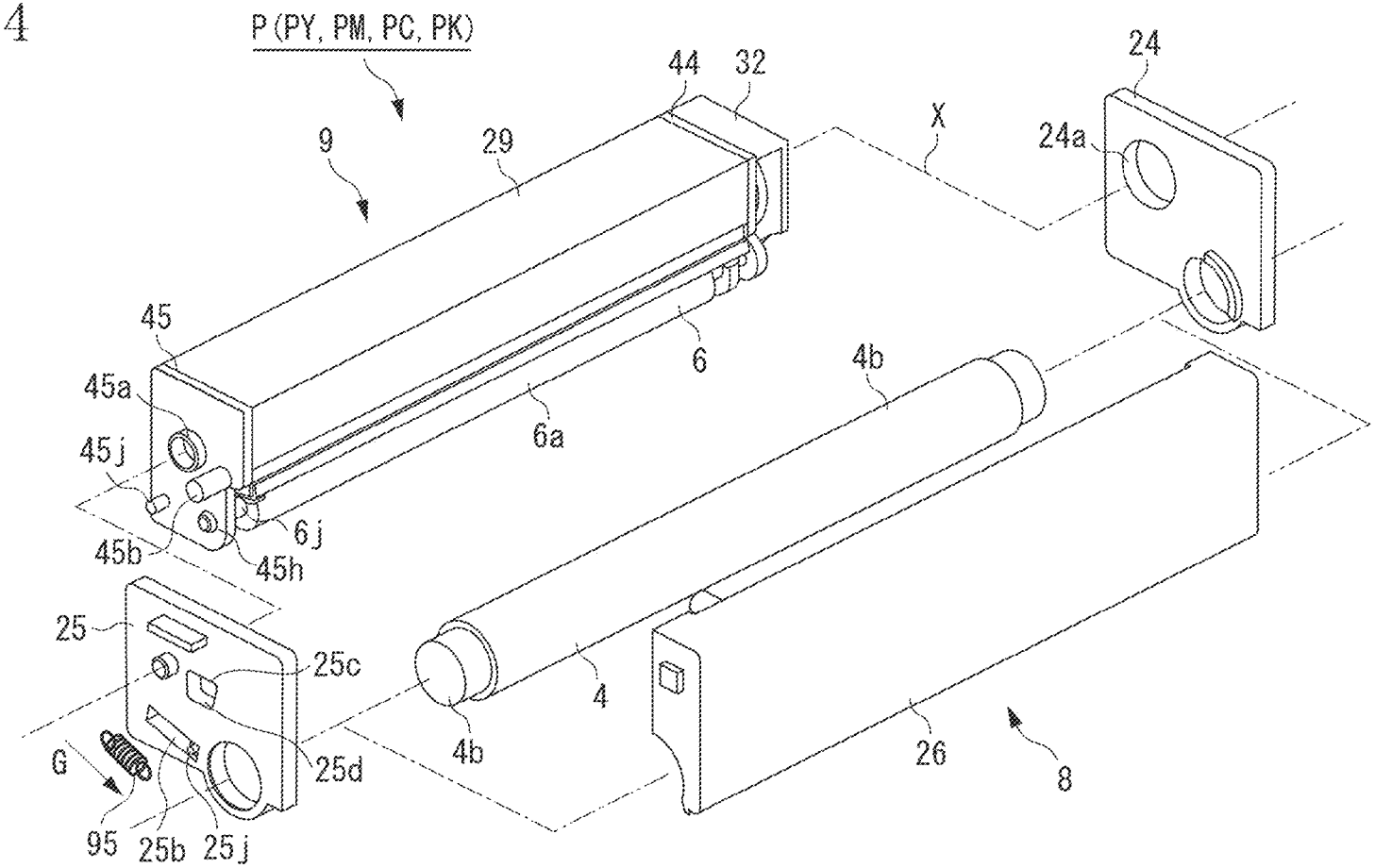
FIG. 4 is an exploded perspective view illustrating a configuration of the process cartridge according to the first exemplary embodiment.

FIG. 1 is a schematic cross-sectional view of the image forming apparatus 1 according to the present exemplary embodiment. FIG. 2 is a cross-sectional view of the process cartridge P according to the present exemplary embodiment. FIG. 3 is an exploded perspective view of the process cartridge P according to the present exemplary embodiment as seen from one end side. FIG. 4 is an exploded perspective view of the process cartridge P according to the present exemplary embodiment as seen from the other end side.

The image forming apparatus 1 illustrated in FIG. 1 is a full-color (4 colors) laser printer using an electrophotographic image forming process, and performs color image formation on the recording material S. The image forming apparatus 1 employs a process cartridge type, and by removably mounting the process cartridge P to an apparatus main body 2 of the image forming apparatus 1, color image can be formed on the recording material S.

For convenience of descriptions, a side where a front door 3 is provided (right-side in FIG. 1) to the image forming apparatus 1 in FIG. 1 is referred to as a front surface side, and a side opposite to the front surface side is referred to as a rear surface side (left-side in FIG. 1). Further, when the image forming apparatus 1 is seen from the front surface side (right-side in FIG. 1), right side of the observer (rear side of paper plane in FIG. 1) is referred to as a driving-side, and left side of the observer (front side of paper plane in FIG. 1) is referred to as non-driving-side.

FIG. 1 is a cross-sectional view illustrating the image forming apparatus 1 viewed from the non-driving-side. Front side of paper plane in FIG. 1 is the non-driving side of the image forming apparatus 1, right side in FIG. 1 is the front surface side of the image forming apparatus 1, and rear side of paper plane of FIG. 1 is the driving side of the image forming apparatus 1.

In the apparatus main body 2, four process cartridges PY, PM, PC, and PK are arranged in a substantially horizontal direction in FIG. 1. Each of the process cartridges PY, PM, PC, and PK includes the same image forming process unit but stores the developer having a different color. To each of the process cartridges PY, PM, PC, and PK, a rotational driving force is transmitted from a drive output portion (not illustrated) provided on the apparatus main body 2.

Further, to each of the process cartridges PY, PM, PC, and PK, a bias voltage (e.g., a developing bias voltage) is supplied from a power source (not illustrated) of the apparatus main body 2.

As illustrated in FIG. 2, each process cartridge P according to the present exemplary embodiment includes a photosensitive drum 4 (image bearing member) that bears an electrostatic latent image on the surface thereof. Furthermore, as an image forming process unit acting on the photosensitive drum 4, the process cartridge P includes a charging roller 5 (charging unit) that uniformly charges the surface of the photosensitive drum 4. Furthermore, the process cartridge P includes a cleaning blade 7 (cleaning member) that scrapes off the developer having remained on the surface of the photosensitive drum 4. Furthermore, the process cartridge P includes a photosensitive drum unit 8 (image bearing member unit) provided with a cleaning container 26 having a waste developer storage portion 27 that stores waste developer scraped off by the cleaning blade 7. The photosensitive drum unit 8 rotatably supports the photosensitive drum 4.

Further, each process cartridge P includes a developing roller 6 (developer bearing member) that supplies toner to an electrostatic latent image formed on the surface of the photosensitive drum 4 to develop it as a toner image. Furthermore, each process cartridge P includes a developing blade 31 that regulates the toner borne on the surface of the developing roller 6 to a given layer thickness. Furthermore, each process cartridge P includes a developing unit 9 including a developing frame member 29 that constitutes a developer storage unit 49 for storing developer. The developing unit 9 rotatably supports the developing roller 6.

The photosensitive drum unit 8 and the developing unit 9 are coupled to be relatively swingable. In other words, the developing unit 9 is provided swingably about the swing center "X" illustrated in FIG. 2 between the contact position illustrated in FIG. 6A at which the developing roller 6 and the photosensitive drum 4 contact to each other and a separated position illustrated in FIG. 6B at which the developing roller 6 and the photosensitive drum 4 are separated from each other, with respect the photosensitive drum unit 8.

The process cartridge PY stores developer of yellow (Y) within the developing frame member 29 of the developing unit 9, and forms a toner image of yellow (Y) on the surface of the photosensitive drum 4.

The process cartridge PM stores developer of magenta (M) within the developing frame member 29 of the developing unit 9, and forms a toner image of magenta (M) on the surface of the photosensitive drum 4.

The process cartridge PC stores developer of cyan (C) within the developing frame member 29 of the developing unit 9, and forms a toner image of cyan (C) on the surface of the photosensitive drum 4.

The process cartridge PK stores developer of black (K) within the developing frame member 29 of the developing unit 9, and forms a toner image of black (K) on the surface of the photosensitive drum 4.

As illustrated in FIG. 1, above the process cartridges PY, PM, PC, and PK, a laser scanner unit 28 (exposure unit) is provided. The laser scanner unit 28 outputs a laser light 33 corresponding to image information. Then, the laser light 33 passes through an exposure window 10 of the process cartridge P and scans and exposes the surface of the photosensitive drum 4.

Below the process cartridges PY, PM, PC, and PK, an intermediate transfer belt unit 11 (transfer member) is provided. The intermediate transfer belt unit 11 includes a driving roller 13 and the tension rollers 14 and 15, and an intermediate transfer belt 12 having flexibility is stretched around the driving roller 13 and the tension rollers 14 and 15.

Each of undersurfaces of the photosensitive drums 4Y, 4M, 4C, and 4K of the process cartridges PY, PM, PC, and PK are in contact with an upper surface of the intermediate transfer belt 12. The contact portion is a primary transfer portion. On an inner peripheral surface side of the intermediate transfer belt 12, primary transfer rollers 16Y, 16M, 16C, and 16K are arranged opposing to the respective photosensitive drums 4.

Further, a secondary transfer roller 17 is arranged at a position opposing to the tension roller 14 via the intermediate transfer belt 12. A contact portion of the intermediate transfer belt 12 and the secondary transfer roller 17 is a secondary transfer portion.

Below the intermediate transfer belt unit 11, a sheet feeding unit 18 is provided. The sheet feeding unit 18 is configured to include a sheet feeding tray 19 in which recording materials S are stacked and stored, and a feeding roller 20 that separates and feeds the recording materials S stacked within the sheet feeding tray 19 one by one with the cooperation of a separation unit (not illustrated).

On an upper-left side in FIG. 1 within the apparatus main body 2, a fixing unit 21 and a discharging unit 22 are provided. On an upper surface of the apparatus main body 2, a discharge tray 23 is provided.

Thereafter, the toner formed on the surface of the recording material S is heated and pressed to be fixed thereon by a fixing unit 21 including a heating roller and a pressure roller, and then the recording material S is discharged onto the discharge tray 23.

<Image Forming Operation>

An operation of forming a full-color image in the image forming apparatus 1 illustrated in FIG. 1 will be described.

The photosensitive drum 4 of each of the process cartridges PY, PM, PC, and PK is rotationally driven in an arrow "D" direction in FIG. 2 at a predetermined circumferential speed.

At this time, also the intermediate transfer belt 12 is circularly driven in an arrow "a" direction in FIG. 1 (forward direction) with respect to a rotational direction of the photosensitive drum 4 at a circumferential speed corresponding to the circumferential speed of the photosensitive drum 4.

Furthermore, the laser scanner unit 28 is also driven. In synchronization with the drive of the laser scanner unit 28, in each process cartridge P, the charging roller 5 uniformly charges the surface of the photosensitive drum 4 to a predetermined electric potential with a predetermined polarity. Then, the laser scanner unit 28 scans and exposes the surface of the uniformly charged photosensitive drum 4 with the laser light 33 depending on an image signal of a corresponding color.

As a result, an electrostatic latent image according to the image signal of the corresponding color is formed on the surface of the photosensitive drum 4. The electrostatic latent image formed on the surface of the photosensitive drum 4 is developed by the developing roller 6 rotationally driven in an arrow "E" direction in FIG. 2 at a predetermined circumferential speed. In the present exemplary embodiment, the developing roller 6 is rotationally driven so that the rotating surface speed of the developing roller 6 is faster than the rotating surface speed of the photosensitive drum 4.

By the above-described electrophotographic image forming process, on the photosensitive drum 4Y of the process cartridge PY, a toner image of yellow (Y) corresponding to yellow (Y) component of the full-color image is formed. Then, the toner image is primarily transferred onto the intermediate transfer belt 12.

Similarly, on the photosensitive drum 4M of the process cartridge PM, a toner image of magenta (M) corresponding to magenta (M) component of the full-color image is formed. Then, the toner image is primarily transferred to be superimposed onto the yellow (Y) toner image which has already been transferred on the intermediate transfer belt 12.

Similarly, on the photosensitive drum 4C of the process cartridge PC, a toner image of cyan (C) corresponding to cyan (C) component of full-color image is formed. Then, the toner image is primarily transferred to be superimposed onto the yellow (Y) and magenta (M) toner images which have already been transferred on the intermediate transfer belt 12.

Similarly, on the photosensitive drum 4K of the process cartridge PK, a toner image of black (K) corresponding to black (K) component of the full-color image is formed. Then, the toner image is primarily transferred to be superimposed onto the yellow (Y), magenta (M), and cyan (C) toner images which have already been transferred on the intermediate transfer belt 12.

In this manner, unfixed toner images for the full-color image consisting of the toner images of the four colors of yellow (Y), magenta (M), cyan (C), and black (K) are formed on the intermediate transfer belt 12.

On the other hand, the recording materials S stacked in the sheet feeding tray 19 are separated and fed one by one at a predetermined control timing. The recording material S is introduced into a secondary transfer portion, which is a contact portion between the secondary transfer roller 17 and the intermediate transfer belt 12, by a registration roller 30 rotationally driven at a predetermined control timing.

As a result, in the process of the recording material S being conveyed through the secondary transfer portion, which is the contact portion between the secondary transfer roller 17 and the intermediate transfer belt 12, the superimposed four color toner images on the intermediate transfer belt 12 are collectively transferred onto the surface of the recording material S.

<Process Cartridge>

In the present exemplary embodiment, each of the process cartridges PY, PM, PC, and PK is configured to include the same image forming process unit, except that colors of the developers stored within the developer storage units 49 of the respective developing units 9Y, 9M, 9C, and 9K and charging amounts of the developers are different from each other.

The process cartridge P includes a photosensitive drum 4, and an image forming process unit acting on the photosensitive drum 4. The image forming process unit includes a charging roller 5 (charging unit) that charges the surface of the photosensitive drum 4.

Furthermore, the process cartridge P includes a developing roller 6 (developing unit) that supplies toner to an electrostatic latent image formed on the surface of the photosensitive drum 4 and develops the toner image. Furthermore, the process cartridge P includes the cleaning blade 7 (cleaning unit) that removes residual developer remaining on the surface of the photosensitive drum 4.

Then, the process cartridge P is divided into the photosensitive drum unit 8 and the developing unit 9. The rotational axis direction of the photosensitive drum 4 is referred to as a longitudinal direction of the photosensitive drum 4. Further, one end side in the longitudinal direction of the process cartridge P is set as the driving-side, and the other end side is set as the non-driving-side.

<Photosensitive Drum Unit>

As illustrated in FIG. 2 through FIG. 4, the photosensitive drum unit 8 includes the photosensitive drum 4, the charging roller 5, the cleaning blade 7, the cleaning container 26, and the waste developer storage portion 27. Furthermore, as illustrated in FIG. 3, the photosensitive drum unit 8 is configured to include a cartridge cover member consisting of a cartridge cover member 24 on the driving-side, and a cartridge cover member 25 on the non-driving-side.

As illustrated in FIG. 3, the photosensitive drum 4 is rotatably supported by the cartridge cover members 24 and 25 provided at both end portions in the longitudinal direction of the process cartridge P. The cartridge cover members 24 and 25 are fixed to the cleaning container 26 at both end sides in the longitudinal direction of the cleaning container 26.

As illustrated in FIG. 3, at one end side in the longitudinal direction of the photosensitive drum 4, there is provided a coupling member 4*a* for transmitting a driving force to the photosensitive drum 4. The coupling member 4*a* engages with a drum drive output portion (not illustrated) provided on the apparatus main body 2, and a driving force of a driving motor (not illustrated) provided on the apparatus main body 2 is transmitted to the photosensitive drum 4 via the coupling member 4*a*.

The charging roller 5 is rotatably supported by the cleaning container 26 so as to contact the surface of the photosensitive drum 4 to be rotated by the rotation of photosensitive drum 4. Further, the cleaning blade 7 is supported by the cleaning container 26 so as to contact the surface of the photosensitive drum 4 with a predetermined pressure.

The transfer residual developer removed from the surface of the photosensitive drum 4 by the cleaning blade 7 is stored in the waste developer storage portion 27 inside the cleaning container 26. On the cartridge cover member 24, there is provided a supporting hole 24*a* (first supporting portion) that is provided at one end side (right side in FIG. 3) in the rotational shaft 4*b* direction (the rotational axis direction) of the photosensitive drum 4, and that swingably supports the developing unit 9. On the cartridge cover member 25, there is provided a projection portion 25*a* (second supporting portion) that is provided at the other end side (left side in FIG. 3) in a rotational shaft 4*b* direction (rotational axis direction) of the photosensitive drum 4, and swingably and movably supports the developing unit 9.

As illustrated in FIG. 4, at both end portions in the longitudinal direction of the developing unit 9, bearing members 44 and 45 that rotatably support the developing roller 6 are provided. On the bearing member 45, an elongated hole 45*a* (second supported portion) is provided. The inner diameter of the elongated hole 45*a* is formed larger than the outer diameter of the projection portion 25*a* protrudingly provided on the cartridge cover member 25 illustrated in FIG. 3. Then, the projection portion 25*a* (second supporting portion) protrudingly provided on the cartridge cover member 25 illustrated in FIG. 3 is fit in and engaged with the inside of the elongated hole 45*a* (second supported portion) provided on the bearing member 45 illustrated in FIG. 4 so that sliding movement is enabled (slidable).

<Developing Unit>

The developing unit 9, as illustrated in FIG. 2 through FIG. 5, is configured to include the developing roller 6, a developing blade 31, the developing frame member 29, a driving side bearing member 44, a non-driving side bearing member 45, and a developing cover member 32. The developing roller 6 is configured to have an elastic layer 6*a* on the surface of a core bar 6*j*. As illustrated in FIG. 2, at a contact position of the developing roller 6 and the photosensitive drum 4, the elastic layer 6*a* of the developing roller 6 and the photosensitive drum 4 are brought into contact to each other.

Figure 5:
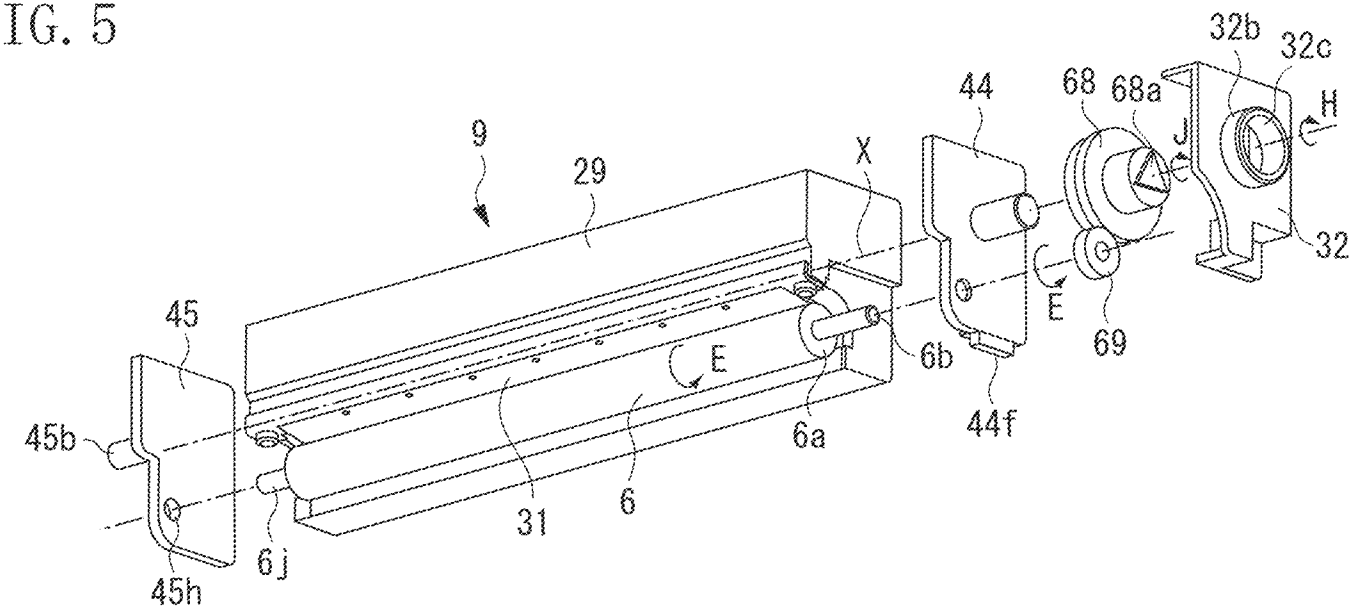
FIG. 5 is an exploded perspective view illustrating a configuration of a developing unit according to the first exemplary embodiment.

The developing frame member 29 includes the developer storage portion 49 that stores the developer to be supplied to the developing roller 6, and the developing blade 31 that regulates a layer thickness of the developer borne on the surface of the elastic layer 6*a* of the developing roller 6. As illustrated in FIG. 5, the driving side bearing member 44 and the non-driving side bearing member 45 are fixed to both end side surfaces in a longitudinal direction of the developing frame member 29, and rotatably support the developing roller 6.

At a position of the swing center X of the developing unit 9 on the driving side illustrated on the right-side in FIG. 5, which is one end side in the rotational shaft 4*b* direction (rotational axis direction) of the photosensitive drum 4, a developing drive input gear 68 (drive input portion) is arranged. The developing drive input gear 68 meshes with a developing roller gear 69 fixed to the core bar 6*j* of the developing roller 6 to rotate the developing roller 6.

On the driving side bearing member 44, the developing drive input gear 68 for transmitting a driving force to the developing roller gear 69 is provided. Then, the developing cover member 32 is fixed to the outside of the driving side bearing member 44 to cover the developing roller gear 69 and the developing drive input gear 68.

As illustrated in FIG. 5, on the driving side of the developing cover member 32 in the longitudinal direction of the developing unit 9, there is provided a cylindrical portion 32*b* (first supported portion) provided at one end side in the rotational shaft 6*b* direction (rotational axis direction) of the developing roller 6, and swingably supported with respect to the photosensitive drum unit 8.

A drive transmitting portion 68*a* protruding in an axial direction of the developing drive input gear 68 is inserted into a through-hole 32*c* provided inside the cylindrical portion 32*b* and is exposed to the outside of the developing cover member 32.

In this process, the drive transmitting portion 68*a* of the developing drive input gear 68, when the process cartridge P is mounted on the apparatus main body 2, engages with a main body side drive transmitting member (not illustrated) provided on the apparatus main body 2. A driving force is transmitted thereto from a driving motor (not illustrated) provided on the apparatus main body 2.

A driving force input to the developing drive input gear 68 from the apparatus main body 2 is transmitted to the developing roller 6 via the developing roller gear 69, and the developing roller 6 is configured to be rotationally driven at a predetermined rotational speed.

As illustrated in FIG. 4, on the non-driving side of the bearing member 45 in the longitudinal direction of the developing unit 9 illustrated on the left-side in FIG. 4, which is the other end side in the rotational shaft 6*b* direction (rotational axis direction) of the developing roller 6, a raised portion 45*b* as a regulated portion is provided. Furthermore, on the bearing member 45, the elongated hole 45*a* as a second supported portion which is swingable with respect to the photosensitive drum unit 8 and movably (slidably) supported with respect to the projection portion 25*a* is provided.

Then, the raised portion 45*b* is inserted into a hole 25*d* provided on the cartridge cover member 25 of the photosensitive drum unit 8, and formed of the through-hole (regulating portion) that regulates the swing about the swing center "X" of the developing unit 9. The raised portion 45*b* can be brought into contact with a regulating surface 25*c* formed of a part of the peripheral wall surface of the hole 25*d*.

The outer diameter of the projection portion 25*a* (second supporting portion) illustrated in FIG. 3 is smaller than the inner circumferential diameter of the elongated hole 45*a* (second supported portion) illustrated in FIG. 4. As a result, the projection portion 25*a* is inserted into the elongated hole 45*a* and is movably supported in the elongated hole 45*a*.

Figure 7:
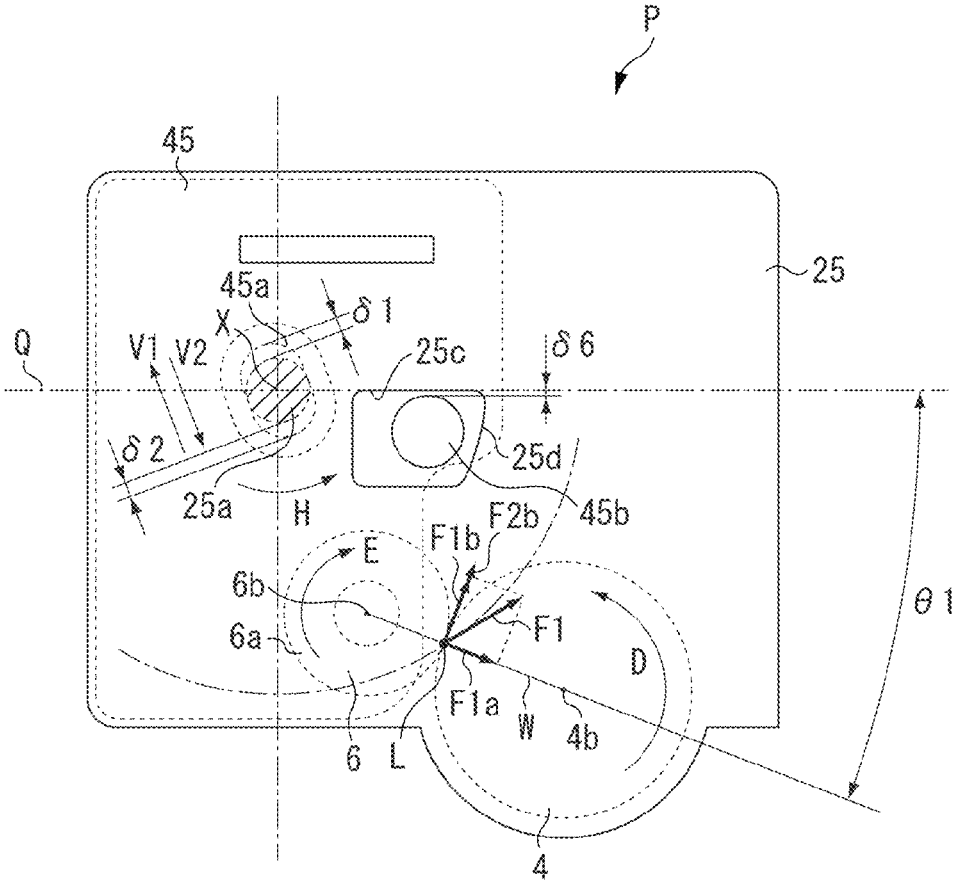
FIG. 7 is a side view illustrating a configuration of the process cartridge according to the first exemplary embodiment.
Figure 8:
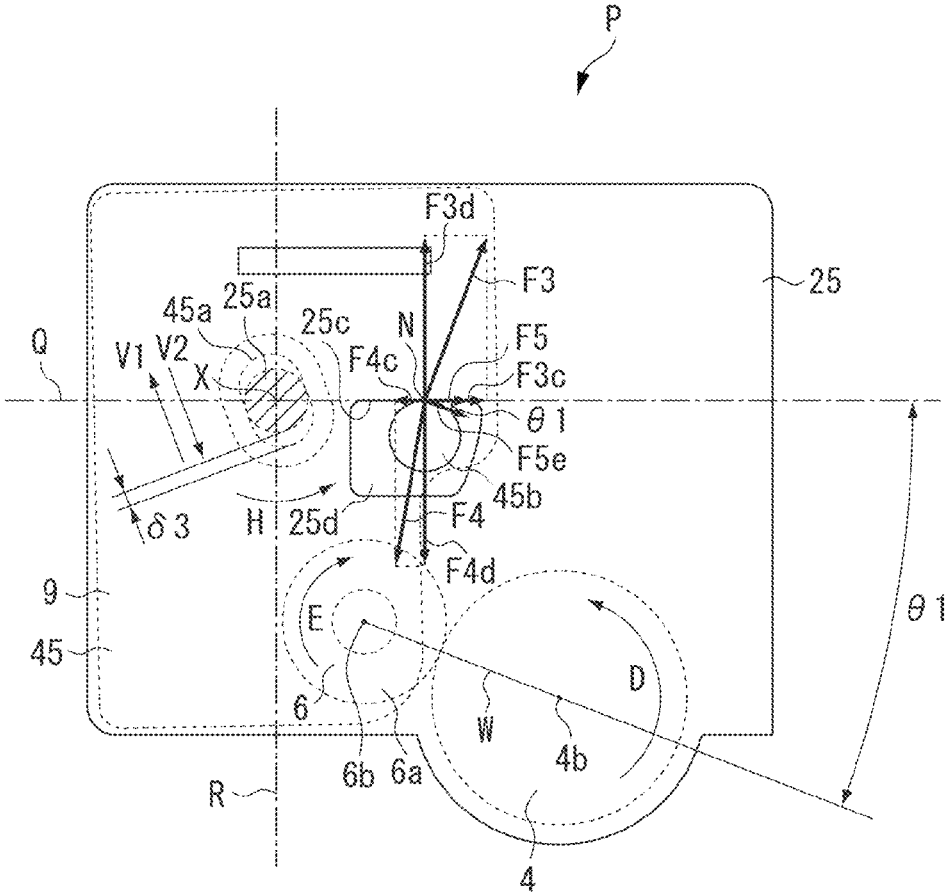
FIG. 8 is a side view illustrating a configuration of the process cartridge according to the first exemplary embodiment.

In the present exemplary embodiment, as illustrated in FIG. 7 and FIG. 8, a plane Q including the regulating surface 25*c* is set to include the swing center "X" of the developing unit 9. That is, in the plane Q, there are the projection portion 25*a* and the elongated hole 45*a*. Further, the raised portion 45*b* provided protrudingly on the non-driving side bearing member 45 of the developing unit 9 is made of an electrically conductive resin, and the electrically conductive resin is continuously formed to a through-hole 45*h* into which at least the core bar 6*j* of the developing roller 6 is rotatably inserted. The raised portion 45*b* is configured as an electric contact member that electrically contacts a developing bias voltage supplying unit (not illustrated) of the apparatus main body 2, thereby energizing the core bar 6*j* of the developing roller 6 via the through-hole 45*h*, and supplying power to the developing roller 6. Thus, a developing bias voltage is applied to the developing roller 6.

<Assembling Photosensitive Drum Unit and Developing Unit>

As illustrated in FIG. 3 and FIG. 4, the developing unit 9 and the photosensitive drum unit 8 are assembled. In that case, an outer diameter portion of the cylindrical portion 32*b* protruding from the developing cover member 32 is fitted into the supporting hole 24*a* (first supporting portion) formed of the through-hole of the driving side cartridge cover member 24 illustrated on the right-side in FIG. 3.

Further, the projection portion 25*a* protruding from the non-driving side cartridge cover member 25 illustrated on the left-side of FIG. 3 is movably fitted into the elongated hole 45*a* provided on the non-driving side bearing member 45 illustrated on the left-side in FIG. 4.

As a result, the developing unit 9 is supported swingably about the swing center "X" with respect to the photosensitive drum unit 8. The swing center "X" of the developing unit 9 with respect to the photosensitive drum unit 8 is an axis line connecting the center of the supporting hole 24*a* (first supporting portion), and the center of the projection portion 25*a* (second supporting portion). The supporting hole 24*a* (first supporting portion) is provided on the driving side cartridge cover member 24 illustrated on the right-side in FIG. 3. The projection portion 25*a* (second supporting portion) is provided on the non-driving side cartridge cover member 25 illustrated on left-side of FIG. 3.

<Contacting Operation of Developing Roller and Photosensitive Drum>

As illustrated in FIG. 4, on the cartridge cover member 25 of the photosensitive drum unit 8, in a direction in which the developing roller 6 is caused to contact the photosensitive drum 4, a pressure spring 95 (urging member) that urges the developing unit 9 is provided.

One end of the pressure spring 95 is locked by a raised portion 25*j* provided on the non-driving side cartridge cover member 25 of the photosensitive drum unit 8. The other end of the pressure spring 95 is locked by a raised portion 45*j* protrudingly provided on the non-driving side bearing member 45 of the developing unit 9 via the through-hole 25*b* provided on the cartridge cover member 25.

Figure 6B:
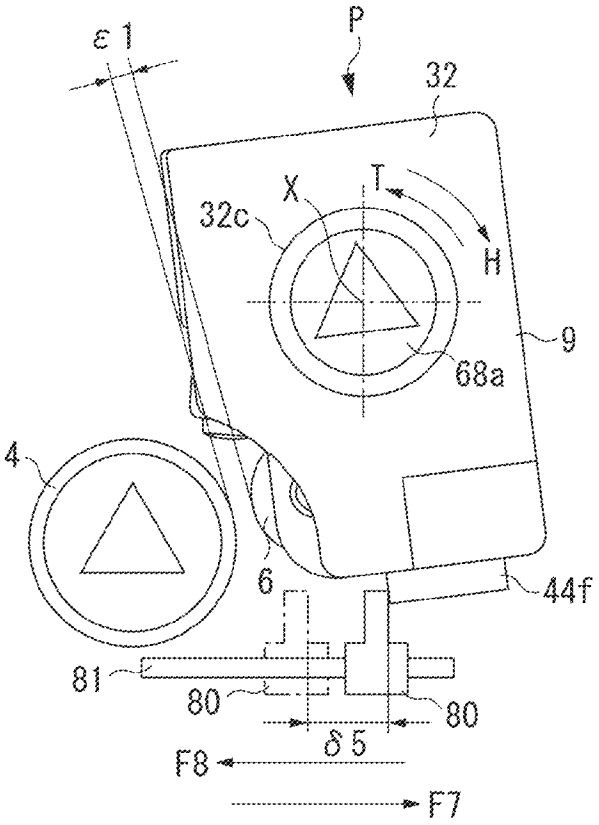
FIGS. 6A and 6B are side views each illustrating a configuration of the process cartridge according to the first exemplary embodiment.
Figure 6A:
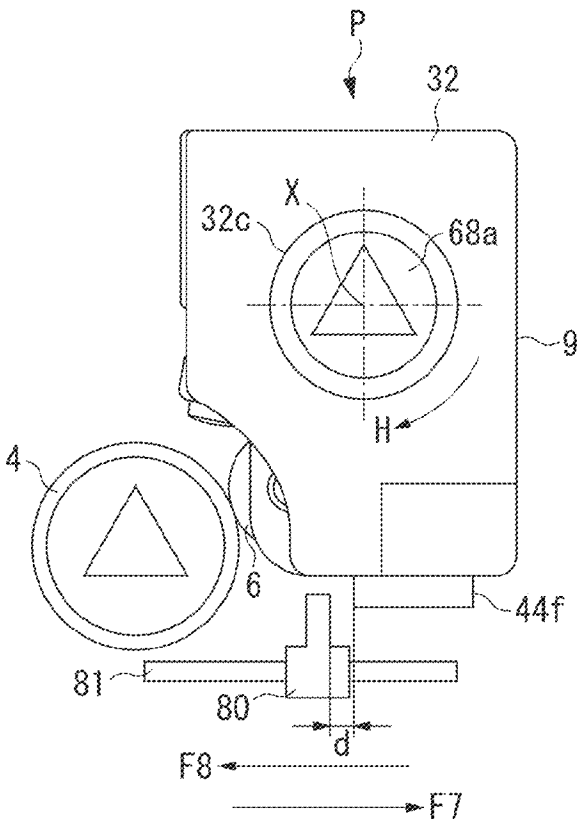

Then, as illustrated in FIG. 2 and FIG. 6A, the developing unit 9 is constantly urged in an arrow "G" direction in FIG. 4 by a tensile force of the pressure spring 95 (elastic member). Thus, a moment constantly acts on the developing unit 9 in an arrow "H" direction in FIG. 2, about the swing center "X". As a result, the developing unit 9 is constantly urged in a clockwise direction in FIG. 6A, about the swing center "X". This allows the developing roller 6 to contact the photosensitive drum 4.

As illustrated in FIG. 5, the developing drive input gear 68 receives a rotational drive force in an arrow "J" direction in FIG. 5 from a main body side drive transmitting member (not illustrated) provided on the apparatus main body 2. A driving force input to the developing drive input gear 68 is transmitted to the developing roller gear 69 meshed with the developing drive input gear 68, and the developing roller gear 69 fixed to the core bar 6*j* of the developing roller 6 rotates in an arrow "E" direction in FIG. 5.

Thus, the developing roller 6 rotates in the arrow "E" direction in FIG. 5. A driving force necessary to rotate the developing roller 6 is input to the developing drive input gear 68 that rotates about the swing center "X" of the developing unit 9, so that a rotating moment is generated in an arrow "H" direction in FIG. 5 on the developing unit 9.

Then, by a tensile force by the pressure spring 95 illustrated in FIG. 4, and a rotational driving force input to the developing drive input gear 68 from the apparatus main body 2, the developing unit 9 receives a rotational moment in the arrow "H" direction in FIG. 6A about the swing center "X", as illustrated in FIG. 6A. Then, the elastic layer 6*a* provided on the surface side of the developing roller 6 is brought into contact to the surface of the photosensitive drum 4 with a predetermined contact pressure.

As illustrated in FIG. 6A, the position of the developing unit 9 with respect to the photosensitive drum unit 8 in a state where the developing roller 6 is in contact with the photosensitive drum 4 is set as a contact position.

In the present exemplary embodiment, the developing roller 6 is urged against the photosensitive drum 4. For this reason, a configuration for using two forces of the urging force by the tensile force of the pressure spring 95, and the rotational driving force input to the developing drive input gear 68 from the apparatus main body 2 has been employed. Alternatively, a configuration for urging the developing roller 6 against the photosensitive drum 4 only by either one force may be employed.

<Separating Operation Between Developing Roller and Photosensitive Drum>

FIGS. 6A and 6B are side views illustrating the process cartridge P viewed from the driving-side. Further, for convenience of descriptions, some components are omitted. As illustrated in FIG. 5, on the driving side bearing member 44, a hook portion 44*f* protruding downward is provided. As illustrated in FIGS. 6A and 6B, the hook portion 44*f* is configured to be engageable with a separation member 80 provided on the apparatus main body 2.

The separation member 80 is configured to receive a driving force from a motor (not illustrated) and to be movable in arrows F7 and F8 directions in FIGS. 6A and 6B along a rail 81. For example, the rail 81 formed of a male screw is rotationally driven by the motor in a predetermined direction, and the separation member 80 can be configured to be movable along the rail 81 in the arrows F7 and F8 directions in FIGS. 6A and 6B, by providing a female screw meshed with the male screw of the rail 81 on the separation member 80.

FIG. 6A illustrates a state where the photosensitive drum 4 and the developing roller 6 are in contact with each other by the urging force by the tensile force of the pressure spring 95, and the rotational driving force input to the developing drive input gear 68 from the apparatus main body 2. At that time, the hook portion 44*f* provided on the driving side bearing member 44, and the separation member 80 are separated from each other having a gap "d".

FIG. 6B illustrates a state where the separation member 80 is moved by a distance 55 in the arrow F7 direction in FIG. 6B along the rail 81 rotationally driven by the motor (not illustrated). At that time, the hook portion 44*f* provided on the driving side bearing member 44 engages with the separation member 80, and the developing unit 9 is in a swung state in an arrow "T" direction in FIG. 6B about the swing center "X" against the tensile force of the pressure spring 95. At that time, the photosensitive drum 4 and the developing roller 6 are in a separated state apart from each other by a distance $\epsilon$1. At that time, the rotational driving force is not input to the developing drive input gear 68 from the apparatus main body 2, and the developing drive input gear 68 is released rotatably.

In this manner, by moving the position of the separation member 80 provided on the apparatus main body 2 along the rail 81, the contact/separation state between the photosensitive drum 4 and the developing roller 6 can be selected as appropriate.

<Swing Regulating Operation of Developing Unit>

FIG. 7 and FIG. 8 are side views illustrating the process cartridge P viewed from the non-driving side. As illustrated in FIG. 4, for the convenience of description of the non-driving side supporting configuration of the developing unit 9 by the cartridge cover member 25 provided on the non-driving side of the process cartridge P, some components are not illustrated in FIG. 7 and FIG. 8.

Further, the photosensitive drum 4, the developing roller 6, and the non-driving side bearing member 45 are illustrated with dashed lines, and to show in an easily understood manner, the projection portion 25*a* (second supporting portion) provided so as to project toward an inner surface side of the cartridge cover member 25 illustrated in FIG. 3 is indicated with hatching in FIG. 7 and FIG. 8.

FIG. 7 illustrates a state where the developing roller 6 and the photosensitive drum 4 are in contact with each other. On the non-driving side bearing member 45 of the developing unit 9, the raised portion 45*b* as the regulated portion is provided. On the cartridge cover member 25, there is provided the regulating surface 25*c* formed of the top surface of the hole 25*d* provided penetrating through the cartridge cover member 25 of the photosensitive drum unit 8 as the regulating portion.

The plane Q including the regulating surface 25*c* provided on the cartridge cover member 25 of the photosensitive drum unit 8 is inclined by an angle θ1 relative to the straight line "W" connecting the rotational shaft 6*b*, which is the rotation center of the developing roller 6, and a rotational shaft 4*b*, which is the rotation center of the photosensitive drum 4.

The elongated hole 45*a* is the second supported portion provided on the non-driving side bearing member 45. The projection portion 25*a* is the second supporting portion provided on the cartridge cover member 25 movably inserted into the elongated hole 45*a*. There is a gap δ1 in an arrow V1 direction in FIG. 7 between the elongated hole 45*a* and the projection portion 25*a*. Furthermore, there is a gap δ2 in an arrow V2 direction in FIG. 7 therebetween.

Therefore, the non-driving side of the developing unit 9 illustrated on the left-side in FIG. 4 is swingable about the swing center "X". Furthermore, the non-driving side of the developing unit 9 is supported by the cartridge cover member 25 in a slidably movable manner in arrows V1 and V2 directions in FIG. 7 along a major axis direction of the elongated hole 45*a* (second supported portion) provided on the non-driving side bearing member 45.

Thus, the alignment between the rotational shaft 6*b*, which is the rotation center of the developing roller 6, and the swing center "X" of the developing unit 9 may be deviated due to component tolerances or the like. Even in that case, the non-driving side of the developing unit 9 supported by the non-driving side cartridge cover member 25 is movable in the arrows V1 and V2 directions in FIG. 7 along the major axis direction of the elongated hole 45*a* (second supported portion) provided on the bearing member 45. Therefore, the developing roller 6 can be uniformly brought into contact with the photosensitive drum 4 in a longitudinal direction (axial direction).

Further, a gap δ6 is provided, as illustrated in FIG. 7, between an outer peripheral top end surface of the raised portion 45*b* as the regulated portion provided so as to project toward an outer surface side of the non-driving side bearing member 45 of the developing unit 9 illustrated on the left-side in FIG. 4, and the regulating surface 25*c*. The regulating surface 25*c* is formed of the top surface of the hole 25*d* provided on the cartridge cover member 25.

In the state illustrated in FIG. 7, the developing unit 9 receives a rotational moment in the arrow "H" direction in FIG. 7 about the swing center "X", by a resultant force of the tensile force of the pressure spring 95 illustrated in FIG. 4, and the rotational driving force input to the developing drive input gear 68 illustrated in FIG. 5 from the apparatus main body 2.

Accordingly, a force F1 by a rotational moment in the arrow "H" direction in FIG. 7 about the swing center "X" of the developing unit 9 acts on the contact point "L" of the elastic layer 6*a* of the developing roller 6 and the photosensitive drum 4. A component force in a direction toward the rotational shaft 4*b*, which is the rotation center of the photosensitive drum 4 of the force F1, is defined as a force F1*a*, and a component force in a direction orthogonal to the force F1*a* is defined as a force F1*b*. In other words, the force F1*a* indicated in FIG. 7 is a contact pressure of the developing roller 6 on the photosensitive drum 4.

By the rotational driving force transmitted from the apparatus main body 2, the developing roller 6 and the photosensitive drum 4 are rotated in arrows "E" and "D" directions in FIG. 7, and the photosensitive drum 4 and the developing roller 6 are rotated so that mutual contact portion is moved in the same direction. A surface speed at which the developing roller 6 rotates is faster than a surface speed at which the photosensitive drum 4 rotates. Due to a difference of the both surface speeds, a force F2*b* acts on the developing unit 9, in a tangential direction at a contact point "L" between the developing roller 6 and the photosensitive drum 4.

A force obtained by combining the force F2*b* acting on the developing unit 9 and the force F1*b* is defined as a force F3 (see FIG. 8). Then, the developing unit 9 maintains a state where the developing roller 6 and the photosensitive drum 4 are in contact with each other by the force 3. A gap δ2 illustrated in FIG. 7 is formed between an inner wall surface in a major axis direction of the elongated hole 45*a* provided on the bearing member 45 illustrated in FIG. 4, and an outer peripheral surface of the projection portion 25*a* provided on the cartridge cover member 25 illustrated in FIG. 3 inserted into the elongated hole 45*a*. The developing unit 9 moves in a direction in which the gap δ2 becomes smaller. In other words, the developing unit 9 moves in a direction in which the elongated hole 45*a* slides (sliding direction) with respect to the projection portion 25*a*. Then, the developing unit 9 swings in the arrow "H" direction in FIG. 7 about the swing center "X" while moving. Such a movement phenomenon of the developing unit 9 is referred to as "excessive swing".

Figure 11:
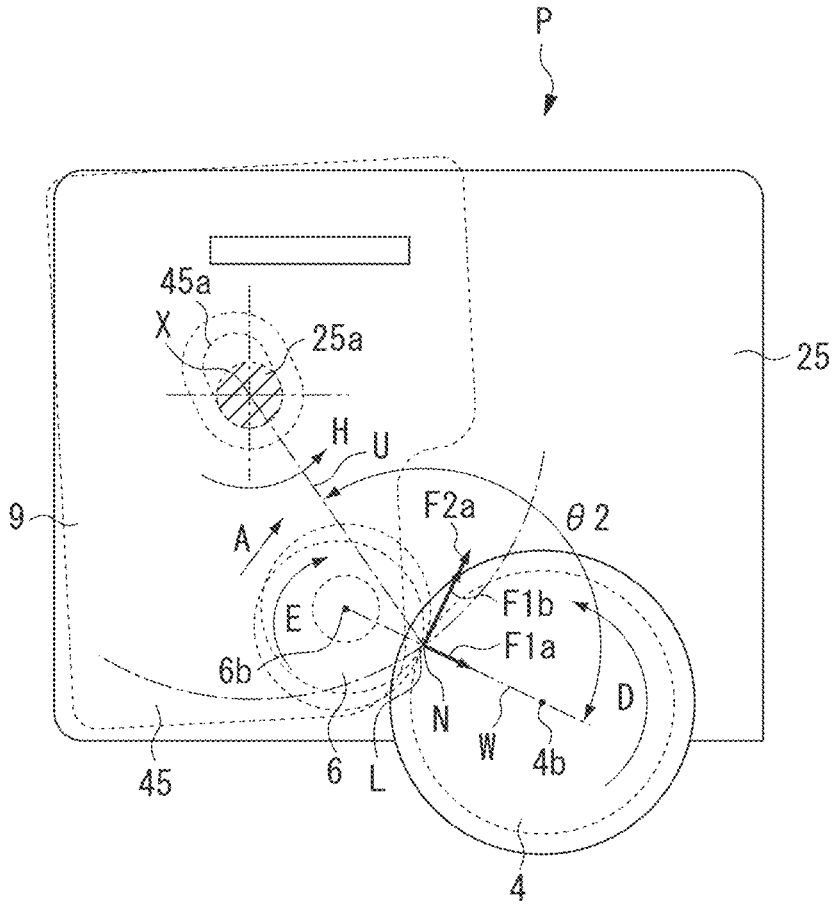
FIG. 11 is a side view illustrating a configuration of a process cartridge.

A configuration of a comparative example in a case of not having the regulating surface 25*c* formed of the top surface of the hole 25*d* penetrating through the cartridge cover member 25 illustrated in FIG. 4 and FIG. 7, and the raised portion 45*b* projecting toward the bearing member 45, is illustrated in FIG. 11.

As illustrated in FIG. 11, in a case where the process cartridge does not include the regulating surface 25*c* and the raised portion 45*b* illustrated in FIG. 7, the developing unit 9, while maintaining a state where the developing roller 6 and the photosensitive drum 4 are in contact with each other, swings in the arrow "H" direction in FIG. 11 about the swing center "X". Then, the developing unit 9 moves until the gap δ2 illustrated FIG. 7 between the inner wall surface in a major axis direction of the elongated hole 45*a* provided on the bearing member 45 illustrated in FIG. 4, and the outer peripheral surface of the projection portion 25*a* provided on the cartridge cover member 25 illustrated in FIG. 3 inserted into the elongated hole 45*a* disappears. As a result, the developing roller 6 moves in an arrow "A" direction in FIG. 11 on the surface of the photosensitive drum 4, and a contact position with respect to the photosensitive drum 4 will be deviated from a predetermined position.

At that time, the angle θ2 formed by the straight line "U" connecting the swing center "X" of the developing unit 9 and the contact point "L" between the developing roller 6 and the photosensitive drum 4, and the straight line "W" connecting the rotational shaft 6*b*, which is the rotation center of the developing roller 6, and the rotational shaft 4*b*, which is the rotation center of the photosensitive drum 4 may become large.

Then, a force F1*b*, which is a component force of the force F1 (see FIG. 7) by a rotational moment in the arrow "H" direction in FIG. 11 about the swing center "X" of the developing unit 9 at the contact point "L" between the developing roller 6 and the photosensitive drum 4, becomes larger. Accordingly, an excessive swing, which is a movement phenomenon of the developing unit 9, is likely to occur.

Along with that, the force F1*a*, which is a component force of the force F1 (see FIG. 7) by a rotation moment in the arrow "H" direction in FIG. 11 about the swing center "X" of the developing unit 9 and is a contact pressure of the developing roller 6 with respect to the photosensitive drum 4 becomes small. Therefore, the contact pressure of the developing roller 6 with respect to the photosensitive drum 4 becomes unstable.

In contrast, in the present exemplary embodiment, as illustrated in FIG. 8, when the developing unit 9 tries to perform excessive swing, then, the raised portion 45*b* as the regulated portion projectingly provided on the bearing member 45 of the developing unit 9 illustrated in FIG. 4, and the regulating surface 25*c* (regulating portion) formed of the upper surface of the hole 25*d* provided to penetrate through the cartridge cover member 25 of the photosensitive drum unit 8 contact to each other as illustrated in FIG. 8.

In other words, in the present exemplary embodiment, as illustrated in FIG. 7, the photosensitive drum 4 and the developing roller 6 contact to each other. Thereafter, as illustrated in FIG. 8, the regulating surface 25*c* (regulating portion) formed of the top surface of the hole 25*d* provided to penetrate through the cartridge cover member 25 of the photosensitive drum unit 8 contacts the raised portion 45*b* as the regulated portion projectingly provided on the bearing member 45 of the developing unit 9.

Accordingly, an attitude position of the developing unit 9 is constrained by three points, i.e., the swing center "X" of the developing unit 9, the contact point "L" between the developing roller 6 and the photosensitive drum 4, and the contact point "N" between the regulating surface 25*c* and the raised portion 45*b*. This will regulate an excessive swing (movement) of the developing unit 9 that occurs in the comparative example illustrated in FIG. 11.

At that time, as illustrated in FIG. 8, a gap δ3 is formed between a wall surface in the major axis direction of the elongated hole 45*a* provided on the bearing member 45, and an outer peripheral surface of the projection portion 25*a* projectingly provided on the cartridge cover member 25 movably inserted into the elongated hole 45*a*. In other words, the elongated hole 45*a* has the gap δ3 for sliding with respect to the projection portion 25*a*. However, if the raised portion 25*ab* contacts the regulating surface 25*c*, the elongated hole portion 45*a* stops sliding with respect to the projection portion 25*a*, and the developing unit 9 also stops moving.

As illustrated in FIG. 11, the present exemplary embodiment is compared with the comparative example in which the process cartridge does not include the regulating surface 25*c* formed of the top surface of the hole 25*d* provided to penetrate through the cartridge cover member 25 of the photosensitive drum unit 8, and the raised portion 45*b* as the regulated portion projectingly provided on the bearing member 45 of the developing unit 9.

In the present exemplary embodiment, as illustrated in FIG. 8, the process cartridge includes the regulating surface 25*c* formed of the top surface of the hole 25*d* provided to penetrate through the cartridge cover member 25 of the photosensitive drum unit 8, and the raised portion 45*b* as the regulated portion projectingly provided on the bearing member 45*d* of the developing unit 9. Accordingly, an excessive swing amount of the developing unit 9 can be reduced to a small level. Thus, the contact position of the developing roller 6 with respect to the photosensitive drum 4 becomes stable.

A gap δ6 between an outer peripheral surface upper end portion of the raised portion 45*b* as the regulated portion projectingly provided on the bearing member 45 illustrated in FIG. 7, and the regulating surface 25*c* formed of the top surface of the hole 25*d* provided to penetrate through the cartridge cover member 25 of the photosensitive drum unit 8 is set as small as possible. Accordingly, the excessive swing amount of the developing unit 9 can be regulated to become smaller.

As illustrated in FIG. 8, an imaginary line orthogonal to the plane "Q" passing through the swing center "X" of the developing unit 9, and including the regulating surface 25*c* formed of the top surface of the hole 25*d* provided to penetrate through the cartridge cover member 25 of the photosensitive drum unit 8 is defined as a straight line "R". In order to regulate the swing in the arrow "H" direction in FIG. 8 about the swing center "X" of the developing unit 9, a contact point "N" between the regulating surface 25*c* and the raised portion 45*b* as the regulated portion projectingly provided on the bearing member 45, is provided in a region of the photosensitive drum 4 side (right-side in FIG. 8) of the straight line "R" illustrated in FIG. 8.

Furthermore, the regulating surface 25*c* is arranged so that the plane "Q" including the regulating surface 25*c* formed of the upper surface of the hole 25*d* provided to penetrate through the cartridge cover member 25 of the photosensitive drum unit 8 passes through the swing center "X" of the developing unit 9. With this configuration, the regulating surface 25*c* is arranged in a direction orthogonal to a movement direction (top-bottom direction in FIG. 8) of the raised portion 45*b* as the regulated portion projectingly provided on the bearing member 45.

In other words, the regulating surface 25*c* arranged orthogonal to a movement direction (top-bottom direction in FIG. 8) of the raised portion 45*b* as the regulated portion projectingly provided on the bearing member 45 and the raised portion 45*b* contact to each other, thereby regulating an excessive swing about the swing center "X" of the developing unit 9.

As a result, due to component tolerances, a position of the raised portion 45*b* as the regulated portion projectingly provided on the bearing member 45 varies, and a gap δ6 (see FIG. 7) between the outer peripheral surface upper end portion of the raised portion 45*b* and the regulating surface 25*c* increases. Even in that case, an excessive swing about the swing center "X" of the developing unit 9 can be minimized. Accordingly, the excessive swing about the swing center "X" of the developing unit 9 can be regulated with high accuracy. As a result, stabilization of the contact pressure of the developing roller 6 with respect to the photosensitive drum 4 can be achieved.

Hereinbelow, arrangement relationship of the regulating surface 25*c* to which the raised portion 45*b* as the regulated portion projectingly provided on the bearing member 45 for regulating the excessive swing about the swing center "X" of the developing unit 9 is contacted, and relationship of a force acting on the contact point "N" between the regulating surface 25*c* and the raised portion 45*b* will be described.

FIG. 8 illustrates the relationship of forces on the regulating surface 25*c* which receives a force F3 that brings the developing unit 9 into excessive swing about the swing center "X" from the raised portion 45*b* as the regulated portion projectingly provided on the bearing member 45.

As illustrated in FIG. 8, a component force in a direction parallel with the regulating surface 25*c* of the force F3 which brings the developing unit 9 into excessive swing about the swing center "X" is defined as a force F3*c*. Furthermore, a component force in a direction orthogonal to the regulating surface 25*c* of the force F3 is defined as a force F3*d*. Then, from the regulating surface 25*c* to resist the force F3*d*, the raised portion 45*b* as the regulated portion projectingly provided on the bearing member 45 of the developing unit 9 receives a force F4*d* as a reaction force.

Further, the raised portion 45*b* as the regulated portion projectingly provided on the bearing member 45 of the developing unit 9 receives a force F4*c* in a direction parallel with the regulating surface 25*c* as a frictional force between the regulating surface 25*c* and the raised portion 45*b* to resist the force F3*c*.

The regulating surface 25*c* (regulating portion) formed of the upper surface of the hole 25*d* provided to penetrate through the cartridge cover member 25 of the photosensitive drum unit 8 can contact the raised portion 45*b* (regulated portion) projectingly provided on the bearing member 45 of the developing unit 9. Then, the angle θ1 formed by the plane "Q" including the regulating surface 25*c*, and the straight line "W" connecting the rotational shaft 6*b* which is the rotation center of the developing roller 6 and the rotational shaft 4*b* which is the rotation center of the photosensitive drum is set to 0° or greater and smaller than 90°.

A force composed of a resultant force in a direction parallel with the regulating surface 25*c* formed of the upper surface of the hole 25*d* provided to penetrate through the cartridge cover member 25 of the photosensitive drum unit 8 is defined as F5. Then, the force F5 is given by the following equation 1.

$$F5=F3c-F4c\geq 0 \quad \text{[Equation 1]}$$

Further, a force F5*e* is composed of a component force in a direction parallel with the straight line "W" connecting the rotational shaft 6*b* which is the rotation center of the developing roller 6 and the rotational shaft 4*b* which is the rotation center of the photosensitive drum 4 of the force F5.

The force F5*e* is given by the following two equations, using the angle θ1 formed by the plane Q including the regulating surface 25*c* provided on the cartridge cover member 25 of the photosensitive drum unit 8, and the straight line "W". The straight line "W" is a straight line connecting the rotational shaft 6*b* which is the rotation center of the developing roller 6, and the rotational shaft 4*b* which is the rotation center of the photosensitive drum 4.

$$F5e=F5\times\sin\theta 1 \quad \text{[Equation 2]}$$

Where, the angle θ1 is set to 0° or greater, and smaller than 90°, and therefore, the force F5*e*≥0 is obtained from these two equations.

In other words, the raised portion 45*b* which is the regulated portion projectingly provided on the bearing member 45 of the developing unit 9 is brought into contact to the regulating surface 25*c* which is the regulating portion formed by the upper surface of the hole 25*d* provided to penetrate through the cartridge cover member 25 of the photosensitive drum unit 8. At that time, the force F5*e* composed of a component force on a direction parallel with the straight line "W" connecting the rotational shaft 6*b* which is the rotation center of the developing roller 6 and the rotational shaft 4*b* which is the rotation center of the photosensitive drum 4 generated on the raised portion 45*b* is "0" or greater.

Accordingly, the force F3 which brings the developing unit 9 into excessive swing about the swing center "X" is received by the regulating surface 25*c*, and the force F5*e* obtained as its component force can be acted as a contact pressure between the developing roller 6 and the photosensitive drum 4.

As a result, while maintaining a contact position of the developing roller 6 with respect to the photosensitive drum 4 with high accuracy, stabilization of the contact pressure of the developing roller 6 with respect to the photosensitive drum 4 can be achieved.

Further, the regulating surface 25*c* is arranged at an angle θ1 so that a force F3*c* illustrated in FIG. 8 becomes equal to or less than a maximum static frictional force of the contact point N. Accordingly, the following equation 3 holds.

$$F3c-F4c=0 \quad \text{[Equation 3]}$$

As a result, when the force F3 which brings the developing unit 9 into excessive swing about the swing center "X" is received by the regulating surface 25*c*, the contact pressure between the developing roller 6 and the photosensitive drum 4 is prevented from varying. Accordingly, the contact pressure between the developing roller 6 and the photosensitive drum 4 can be obtained stably.

The raised portion 45*b* which is the regulated portion projectingly provide on the bearing member 45 of the developing unit 9 is an electric contact member for supplying power to the developing roller 6 by coming into contact with a developing bias voltage supply portion (not illustrated) of the apparatus main body 2.

An attitude of the developing unit 9 is determined by regulating the excessive swing about the swing center "X" of the developing unit 9 by the raised portion 45*b* as the electric contact member. Therefore, positional accuracy of the raised portion 45*b* as the electric contact member is improved. As a result, positional accuracy of the raised portion 45*b* as the electric contact member with respect to the electric contact (not illustrated) of the apparatus main body 2 is improved. Therefore, more stable power feeding is possible.

Furthermore, the outer diameter of the hole 25*d* for allowing penetration of the cartridge cover member 25 of the photosensitive drum unit 8 for exposing the raised portion 45*b* as the electric contact member to the apparatus main body 2 can be made smaller. As a result, rigidity of the cartridge cover member 25 can be made higher.

In the present exemplary embodiment, in order to urge the developing roller 6 with respect to the photosensitive drum 4, a configuration of using two forces of an urging force caused by the tensile force of the pressure spring 95 illustrated in FIG. 4, and a rotational driving force transmitted to the developing drive input gear 68 from the apparatus main body 2 illustrated in FIG. 5 is employed. Alternatively, a configuration urging the developing roller 6 with respect to the photosensitive drum 4 by only any one of the above-described forces may be employed.

Next, a configuration of a process cartridge according to a second exemplary embodiment will be described with reference to FIG. 9. The components similarly configured to those in the first exemplary embodiment are assigned the same reference numerals, and therefore the descriptions thereof will not be repeated.

In the first exemplary embodiment, as illustrated in FIG. 7 and FIG. 8, a major axis direction of the elongated hole 45*a*, which is the second supported portion provided on the bearing member 45 of the developing unit 9, is arranged inclined at a predetermined angle with respect to the vertical direction (top-bottom direction in FIG. 7 and FIG. 8).

Figure 9:
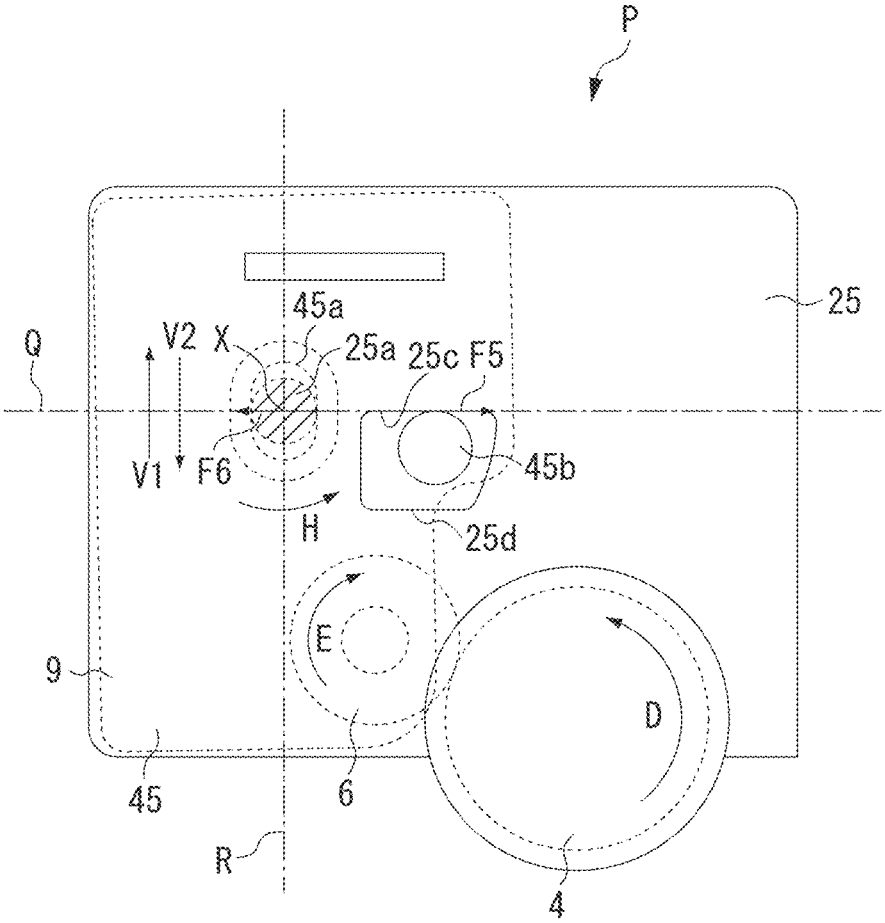
FIG. 9 is a side view illustrating a configuration of a process cartridge according to a second exemplary embodiment.

In the present exemplary embodiment, as illustrated in FIG. 9, the major axis direction of the elongated hole 45*a*, which is the second supported portion provided on the bearing member 45 of the developing unit 9, is arranged in a vertical direction (top-bottom direction in FIG. 9).

As illustrated in FIG. 9, the plane Q including the regulating surface 25*c*, which is the regulating portion formed of the upper surface of the hole 25*d* provided to penetrate through the cartridge cover member 25 of the photosensitive drum unit 8, and a major axis direction of the elongated hole 45*a*, which is the second supported portion, are orthogonal to each other. The elongated hole 45*a* is provided on the bearing member 45 of the developing unit 9

In other words, the elongated hole 45*a* is movably fitted to the projection portion 25*a*, which is the second supporting portion projecting from the cartridge cover member 25 of the photosensitive drum unit 8 illustrated in FIG. 3. Via the elongated hole 45*a*, which is the second supported portion provided on the bearing member 45 of the developing unit 9 illustrated in FIG. 4, directions (directions indicated by arrows V1 and V2 in FIG. 9) in which the non-driving side of the developing unit 9 is movable, is orthogonal to the plane Q including the regulating surface 25*c*.

In the configuration of the present exemplary embodiment, the force F3 (see FIG. 8) which brings the developing unit 9 into excessive swing about the swing center "X" is received by the regulating surface 25*c*. At that time, a force F6 which is a reaction force equivalent to a force F5 composed of a resultant force in a direction parallel with the regulating surface 25*c* is received by the projection portion 25*a*. As illustrated in FIG. 3, the projection portion 25*a*, which is the second supporting portion, projects toward the cartridge cover member 25 of the photosensitive drum unit 8 from the wall surface of the elongated hole 45*a*, which is the second supported portion provided on the bearing member 45 of the developing unit 9.

With this configuration, a force F5 and a force F6 in a direction parallel with the regulating surface 25*c* are balanced. As a result, the contact pressure between the developing roller 6 and the photosensitive drum 4 is prevented from varying. Accordingly, the contact pressure between the developing roller 6 and the photosensitive drum 4 can be obtained more stably. Other configurations are similar to the first exemplary embodiment, and therefore similar effects can be obtained.

Next, a configuration of a third the exemplary embodiment of a process cartridge according to a third exemplary embodiment will be described with reference to FIG. 10. The components configured similarly to the exemplary embodiments described above are assigned the same reference numerals, and therefore descriptions thereof will not be repeated.

In the exemplary embodiments described above, the raised portion 45*b* as the regulated portion projectingly provided on the non-driving side bearing member 45 of the developing unit 9 illustrated in FIG. 4 contacts the regulating surface 25*c*, which is the regulating portion. The regulating surface 25*c* is formed of the upper surface of the hole portion 25*d* provided to penetrate through the cartridge cover member 25 of the photosensitive drum unit 8. Thus, a configuration for regulating an excessive swing about the swing center "X" of the developing unit 9 can be obtained.

Figure 10:
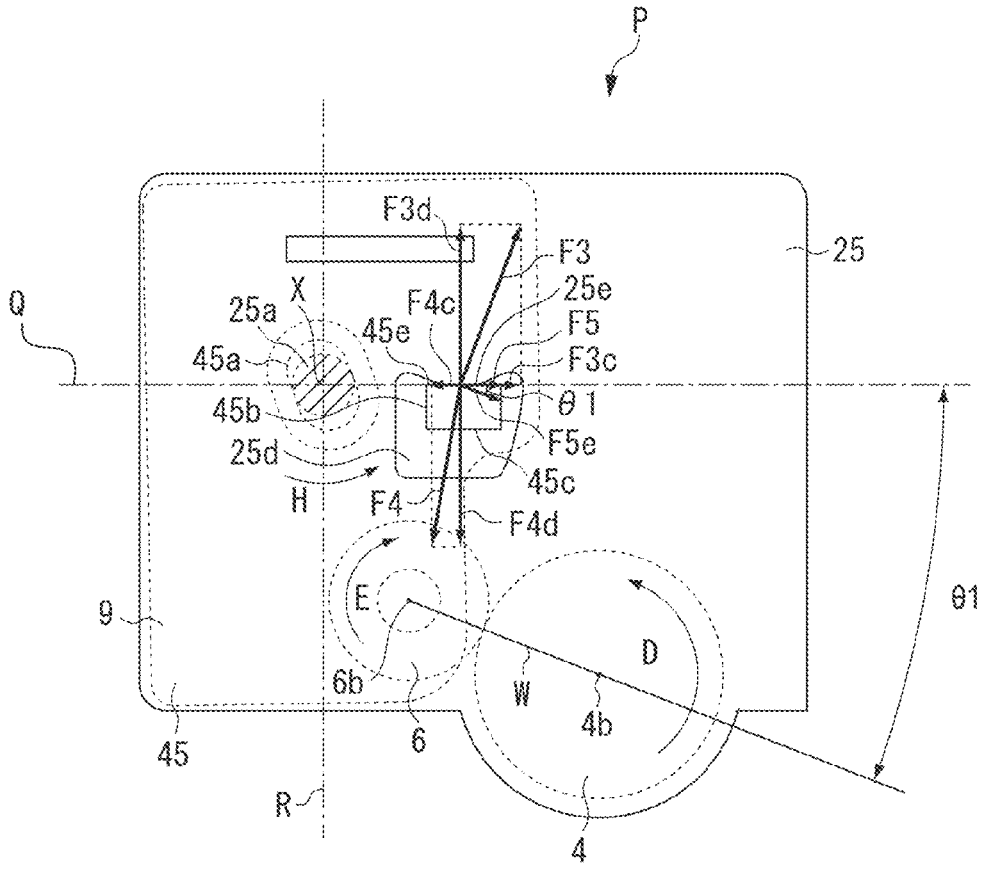
FIG. 10 is a side view illustrating a configuration of a process cartridge according to a third exemplary embodiment.

In the present exemplary embodiment, as illustrated in FIG. 10, the projection portion 45*c* projecting toward an outer side of the non-driving side bearing member 45 of the developing unit 9 is provided, and the regulating surface 45*e* formed of a upper surface of the projection portion 45*c* is configured as the regulating portion that regulates the excessive swing about the swing center "X" of the developing unit 9. Furthermore, the raised portion 25*e* projecting downward on an upper surface of an peripheral wall portion of the hole 25*d* that penetrates through the cartridge cover member 25 of the photosensitive drum unit 8 illustrated in FIG. 3, is configured as the regulated portion that can contact the regulating surface 45*e* (regulating portion) formed of a upper surface of the projection portion 45*c*.

The plane "Q" including the regulating surface 45*e* formed of the surface of the projection portion 45*c* projecting toward an outer side of the non-driving side bearing member 45 of the developing unit 9 is inclined by an angle θ1 relative to the straight line "W" connecting the rotational shaft 6*b*, which is the rotation center of the developing roller 6, and the rotational shaft 4*b*, which is the rotation center of the photosensitive drum 4.

As a result, an excessive swing amount about the swing center "X" of the developing unit 9 can be suppressed to a small level. Thus, the contact position of the developing roller 6 with respect to the photosensitive drum 4 becomes stable. Further, by receiving the force F3 which brings the developing unit 9 into excessive swing about the swing center "X" by the regulating surface 45*e*, a force F5*e* in a direction in which the contact pressure between the developing roller 6 and the photosensitive drum 4 is not reduced can be acted, in a similar manner to the first exemplary embodiment described above. Other configurations are similar to the first exemplary embodiment, and therefore, similar effects can be obtained.

As described above, with the configuration of the above-described respective exemplary embodiments, accuracy improvement of the contact position of the developer bearing member with respect to the image bearing member and stabilization of the contact pressure can be achieved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-199099 filed Sep. 11, 2012, which is hereby incorporated by reference herein in its entirety.

What is claimed is:

1. A process cartridge mountable/demountable to an apparatus main body of an image forming apparatus, the process cartridge comprising:

an image bearing member unit configured to rotatably support an image bearing member; and a developing unit configured to rotatably support a developer bearing member, wherein the image bearing member unit includes:

a first supporting portion provided at one end side in a rotational axis direction of the image bearing member, configured to swingably support the developing unit;

a second supporting portion provided at an other end side in the rotational axis direction of the image bearing member, configured to swingably and slidably support the developing unit; and a regulating portion configured to regulate movement of the developing unit, wherein the developing unit includes:

a first supported portion provided at one end side in a rotational axis direction of the developer bearing member, configured to be swingably supported with respect to the first supporting portion;

a second supported portion provided at an other end side in the rotational axis direction of the developer bearing member, configured to be swingably and slidably supported with respect to the second supporting portion; and a regulated portion configured to be capable of contacting the regulating portion provided on the image bearing member unit, wherein the regulating portion prevents the developing unit from moving in a slide direction of the second supported portion, by contacting the regulated portion at a different position from contact portions where the developer bearing member and the image bearing member contact to each other, when the image bearing member and the developer bearing member rotate while contacting to each other.

2. The process cartridge according to claim 1, wherein the image bearing member and the developer bearing member rotate so as to move the contact portions thereof in a same direction, and to cause a surface speed of the developer bearing member to be faster than a surface speed of the image bearing member.

3. The process cartridge according to claim 1, wherein the developer bearing member has an elastic layer on a surface thereof, wherein at the contact portions at which the developer bearing member and the image bearing member contact to each other, the elastic layer of the developer bearing member and the image bearing member contact to each other.

4. The process cartridge according to claim 1, wherein the image bearing member unit includes an urging member configured to urge the developing unit in a direction in which the developer bearing member is caused to contact the image bearing member.

5. The process cartridge according to claim 1, wherein the regulating portion provided on the image bearing member unit includes a regulating surface to which the regulated portion provided on the developing unit can contact, and an angle formed by a plane including the regulating surface, and a straight line connecting a rotation center of the developer bearing member and a rotation center of the image bearing member is 0° or greater, and smaller than 90°.

6. The process cartridge according to claim 5, wherein the second supporting portion and the second supported portion are located on a the plane including the regulating surface.

7. The process cartridge according to claim 5, wherein the developing unit is configured to be provided swingably about the first supported portion and the second supported portion with respect to the image bearing member unit, and wherein the plane including the regulating surface is set to include a swing center of the developing unit.

8. The process cartridge according to claim 1, wherein the developing unit includes a bearing member that rotatably supports the developer bearing member, and wherein the regulated portion provided on the developing unit is provided on the bearing member, and the regulated portion is configured as an electric contact member for feeding electric power to the developer bearing member.

9. The process cartridge according to claim 1, wherein a force generated when the regulating portion and the regulated portion contact to each other acts to urge the developer bearing member toward the image bearing member.

10. The process cartridge according to claim 1, wherein rotation of the image bearing member and the developer bearing member generates a force at the contact portions at which the developer bearing member and the image bearing member contact to each other, and when the generated force causes the developing unit to move in the slide direction, the regulating portion and the regulated portion go into a contact state where the regulating portion and the regulated portion contact to each other from a separation state where the regulated portion separates from the regulating portion.

11. The process cartridge according to claim 1, wherein the developing unit is configured to be provided swingably about the first supported portion and the second supported portion with respect to the image bearing member unit, between a contact position at which the developer bearing member and the image bearing member contact to each other and a separation position at which the developer bearing member and the image bearing member separate from each other.

12. The process cartridge according to claim 11, further comprising a driving input unit configured to rotate the developer bearing member about a swing center of the developing unit on the one end side in the rotational axis direction of the image bearing member.

13. An image forming apparatus configured to form an image on a recording medium, the image forming apparatus comprising:

an apparatus main body of the image forming apparatus; and a process cartridge configured to be removably mountable to the apparatus main body, wherein the process cartridge includes:

an image bearing member unit configured to rotatably support an image bearing member; and a developing unit configured to rotatably support a developer bearing member, wherein the image bearing member unit includes:

a first supporting portion provided at one end side in a rotational axis direction of the image bearing member, configured to swingably support the developing unit;

a second supporting portion provided at an other end side in the rotational axis direction of the image bearing member, configured to swingably and slidably support the developing unit; and a regulating portion configured to regulate movement of the developing unit, wherein the developing unit includes:

a first supported portion provided at one end side in a rotational axis direction of the developer bearing member, configured to be swingably supported with respect to the first supporting portion;

a second supported portion provided at an other end side in the rotational axis direction of the developer bearing member, configured to be swingably and slidably supported with respect to second supporting portion; and a regulated portion configured to be capable of contacting the regulating portion provided on the image bearing member unit, wherein the regulating portion prevents the developing unit from moving in a slide direction of the second supported portion, by contacting the regulated portion at a different position from contact portions where the developer bearing member and the image bearing member contact to each other, when the image bearing member and the developer bearing member rotate while contacting to each other.

14. The image forming apparatus according to claim 13, wherein the image bearing member and the developer bearing member rotate so as to move the contact portions thereof in a same direction, and to cause a surface speed of the developer bearing member to be faster than a surface speed of the image bearing member.

15. The image forming apparatus according to claim 13, wherein the developer bearing member has an elastic layer on a surface thereof, and wherein at the contact portions at which the developer bearing member and the image bearing member contact to each other, the elastic layer of the developer bearing member and the image bearing member contact to each other.

16. The image forming apparatus according to claim 13, wherein the image bearing member unit includes an urging member that urges the developing unit in a direction in which the developer bearing member is caused to contact the image bearing member.

17. The image forming apparatus according to claim 13, wherein the regulating portion provided on the image bearing member unit includes a regulating surface to which the regulated portion provided on the developing unit can contact, and an angle formed by a plane including the regulating surface, and a straight line connecting a rotation center of the developer bearing member and a rotation center of the image bearing member is 0° or greater, and smaller than 90°.

18. The image forming apparatus according to claim 17, wherein the second supporting portion and the second supported portion are located on the plane including the regulating surface.

19. The image forming apparatus according to claim 17, wherein the developing unit is configured to be provided swingably about the first supported portion and the second supported portion with respect to the image bearing member unit, and wherein the plane including the regulating surface is set to include a swing center of the developing unit.

20. The image forming apparatus according to claim 13, wherein the developing unit includes a bearing member that rotatably supports the developer bearing member, and wherein the regulated portion provided on the developing unit is provided on the bearing member, and the regulated portion is configured as an electric contact member for feeding electric power to the developer bearing member.

21. The image forming apparatus according to claim 13, wherein rotation of the image bearing member and the developer bearing member generates a force at the contact portions where the developer bearing member and the image bearing member contact to each other, and when the generated force causes the developing unit to move in the slide direction, the regulating portion and the regulated portion go into a contact state where the regulating portion and the regulated portion contact each other from a separation state where the regulated portion separates from the regulating portion.

22. The image forming apparatus according to claim 13, wherein a force generated when the regulating portion and the regulated portion contact to each other acts to urge the developer bearing member toward the image bearing member.

23. The image forming apparatus according to claim 13, wherein the developing unit is configured to be provided swingably about the first supported portion and the second supported portion with respect to the image bearing member unit, between a contact position at which the developer bearing member and the image bearing member contact each other and a separation position at which the developer bearing member and the image bearing member separate from each other.

24. The image forming apparatus according to claim 23, further comprising:

a drive input portion located at a position of a swing center of the developing unit at the one end side in the rotational axis direction of the image bearing member, configured to rotate the developer bearing member.

* * * * *